US011341951B2

(12) United States Patent
Lee et al.

(10) Patent No.: US 11,341,951 B2
(45) Date of Patent: May 24, 2022

(54) ONE-WAY SOUND TRANSMISSION STRUCTURE

(71) Applicant: Toyota Motor Engineering & Manufacturing North America, Inc., Plano, TX (US)

(72) Inventors: Taehwa Lee, Ann Arbor, MI (US); Hideo Iizuka, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 730 days.

(21) Appl. No.: 16/196,509

(22) Filed: Nov. 20, 2018

(65) Prior Publication Data

US 2020/0160830 A1 May 21, 2020

(51) Int. Cl.
*G10K 11/20* (2006.01)
*G10K 13/00* (2006.01)

(52) U.S. Cl.
CPC ..... *G10K 11/20* (2013.01); *G10K 13/00* (2013.01)

(58) Field of Classification Search
CPC ..... G10K 11/20; G10K 13/00
USPC ..... 181/173
See application file for complete search history.

(56) References Cited

U.S. PATENT DOCUMENTS 7,733,198 B1 * 6/2010 Olsson ..... G10K 11/20 333/187
11,056,090 B2 * 7/2021 Martin ..... G10K 11/162
2016/0013871 A1 * 1/2016 Sinha ..... H04B 11/00 367/137

FOREIGN PATENT DOCUMENTS

CN 105895074 A 8/2016
JP 2009055474 A * 3/2009 ..... B06B 1/0292

OTHER PUBLICATIONS

Zhang et al., "Enhancement of asymmetric acoustic transmission based on a plate with periodic stepped resonators", Indian Journal of Pure & Applied Physics, vol. 53, Jun. 2015, pp. 371-375 (5 pages).
Zhu et al., "Acoustic one-way open tunnel by using metasurface", CrossMark, Applied Physics Letters 107, 2015, (4 pages).
Popa et al., "Non-reciprocal and highly nonlinear active acoustic metamaterials", Nature Communications, Published Feb. 27, 2014, (5 pages).
Xie et al., "Multiband Asymmetric Transmission of Airborne Sound by Coded Metasurfaces", American Physical Society, Published Feb. 9, 2017, (5 pages).

* cited by examiner

*Primary Examiner* — Forrest M Phillips
(74) *Attorney, Agent, or Firm* — Christopher G. Darrow; Darrow Mustafa PC

(57) ABSTRACT

One-way sound transmission devices include a planar, acoustically reflective substrate having an aperture that is traversed by an elastic membrane. On one face of the substrate, two resonators are symmetrically spaced apart from the membrane at a first distance, configured to enable constructive interference between the resonators and the membrane. On the opposite face of the substrate, two other resonators are symmetrically spaced apart from the membrane at a second, greater, distance, configured to enable destructive interference between the resonators and the membrane.

20 Claims, 4 Drawing Sheets

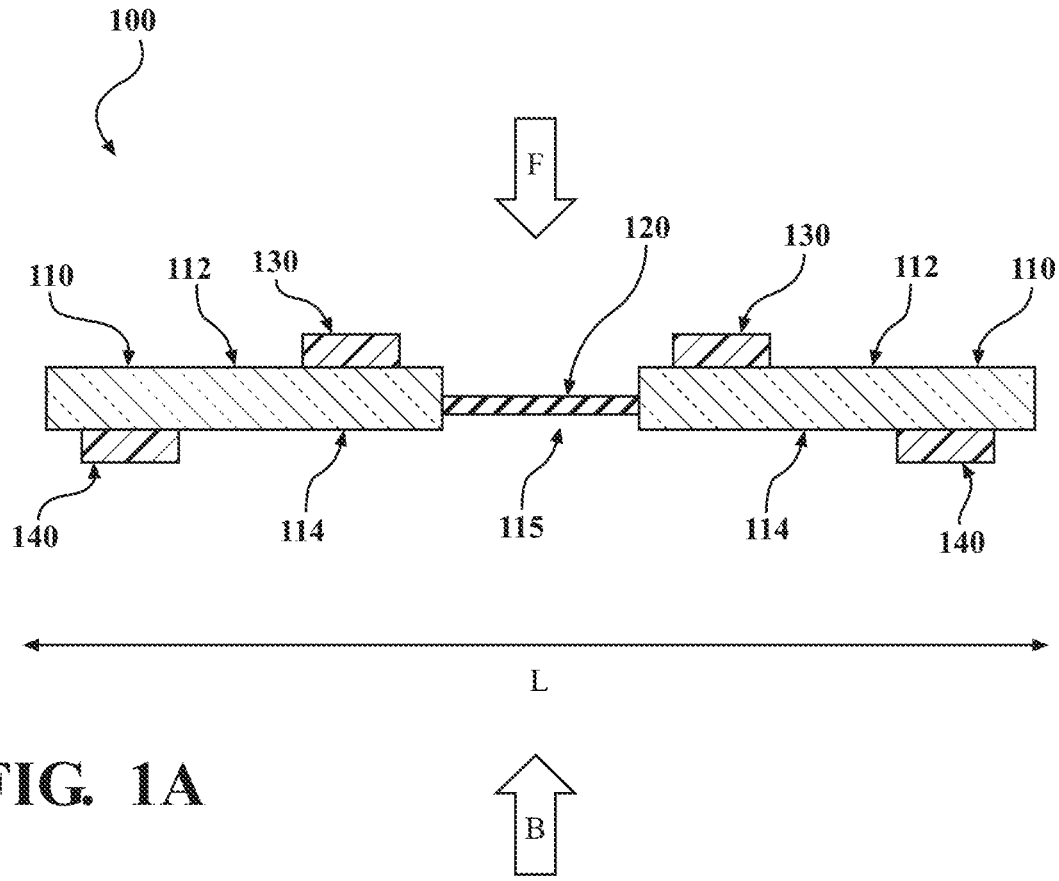
FIG. 1A
FIG. 1B
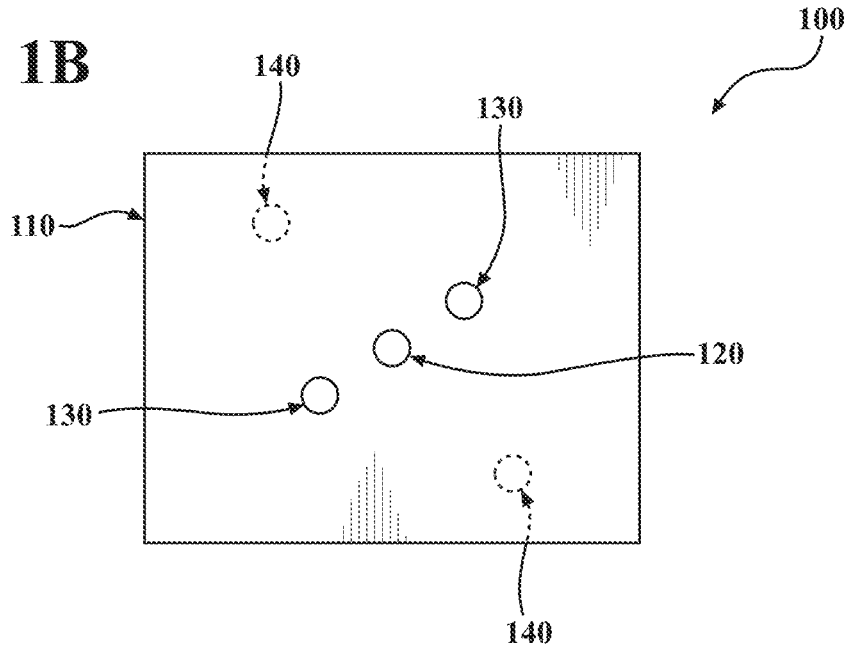

ONE-WAY SOUND TRANSMISSION STRUCTURE

TECHNICAL FIELD

The present disclosure generally relates to selective acoustic transmission devices, and more particularly, to undirectional sound transmission devices.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Conventional devices for one-way sound transmission are based on metamaterials, i.e. periodic structures composed of subwavelength acoustic scatterers. While this design provides useful properties different from a bulk material, such metamaterials have complex design and thus can be time-consuming and expensive to manufacture.

Accordingly, it would be desirable to provide an improved design for one-way sound transmission devices, having greater simplicity and thus greater ease and economy of manufacture.

SUMMARY

This section provides a general summary of the disclosure, and is not a comprehensive disclosure of its full scope or all of its features.

In various aspects, the present teachings provide a one-way sound transmission device. The device includes a substantially planar substrate formed of an acoustically reflective material. The substrate includes a first surface, a second surface opposite the first surface, and an aperture. The device includes an elastic membrane traversing the aperture and having a resonance frequency, $f_0$. The device further includes a first pair of resonators positioned on the first surface and having the resonance frequency, $f_0$. Each resonator of the first pair of resonators is spaced apart from the aperture by a center-to-center distance, of about $0.6\lambda_0$, where $\lambda_0$ is the wavelength corresponding to $f_0$. The device further includes a second pair of resonators positioned on the second surface and having the resonance frequency, $f_0$. Each resonator of the second pair of resonators is spaced apart from the aperture by a center-to-center distance, of about $1.2\lambda_0$.

In other aspects, the present teachings provide a one-way sound transmission device. The device includes a substantially planar substrate formed of an acoustically reflective material. The device substrate includes a first surface; a second surface opposite the first surface; and an aperture. The device includes a dipole acoustic resonator positioned in the aperture and having a resonance frequency, $f_0$. The device further includes a first pair of monopole resonators positioned on the first surface and having the resonance frequency, $f_0$. Each resonator of the first pair of resonators is spaced apart from the aperture by a center-to-center distance, $0.6\lambda_0$, where $\lambda_0$ is the wavelength corresponding to $f_0$, and configured to resonantly reflect acoustic waves impinging on the first surface. The device further includes a second pair of monopole resonators positioned on the second surface and having the resonance frequency, $f_0$. Each resonator of the second pair of resonators is spaced apart from the aperture by a center-to-center distance, $1.2\lambda_0$, and configured to resonantly reflect acoustic waves impinging on the second surface.

In still other aspects, the present teachings provide a one-way sound transmission panel, formed of a two-dimensional array of periodic unit cells. Each unit cell has a substantially planar glass substrate. The substrate has a first surface, a second surface opposite the first surface, and an aperture. The unit cell includes an elastic membrane traversing the aperture and having a resonance frequency, $f_0$. The unit cell further includes a first pair of resonators positioned on the first surface and having the resonance frequency, $f_0$. Each resonator of the first pair of resonators is spaced apart from the aperture by a center-to-center distance, of about $0.6\lambda_0$, where $\lambda_0$ is the wavelength corresponding to $f_0$. The unit cell further includes a second pair of resonators positioned on the second surface and having the resonance frequency, $f_0$. Each resonator of the second pair of resonators is spaced apart from the aperture by a center-to-center distance, of about $1.2\lambda_0$.

Further areas of applicability and various methods of enhancing the above coupling technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein:

FIG. 1A is a side schematic view of a one-way sound transmission device of the present teachings;

FIG. 1B is a top plan view of the device of FIG. 1A, viewed along the line 1B-1B of FIG. 1A;

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present teachings provide various devices and structures that enable one-way sound transmission. In particular, the devices and structure of the present teachings provide differential sound transmission, across a particular wavelength range, between "forward" and "backward" directions.

The devices of the present teachings have a straightforward structure, and yet provide a substantial sound transmission differential.

A particular device of the present teachings deploys an acoustically reflective substrate with an aperture. The aperture is traversed by an elastic membrane, or other bidirectional acoustic resonator. On one side of the substrate, the elastic membrane is symmetrically surrounded by acoustic resonators at a lesser distance, allowing constructive interference and thereby enabling transmission through the membrane of sound wave propagating from that direction. On the other side of the substrate, the elastic membrane is symmetrically surrounded by acoustic resonators at a greater distance, allowing destructive interference and thereby preventing transmission through the membrane of sound wave propagation from that direction.

Figure 1C:
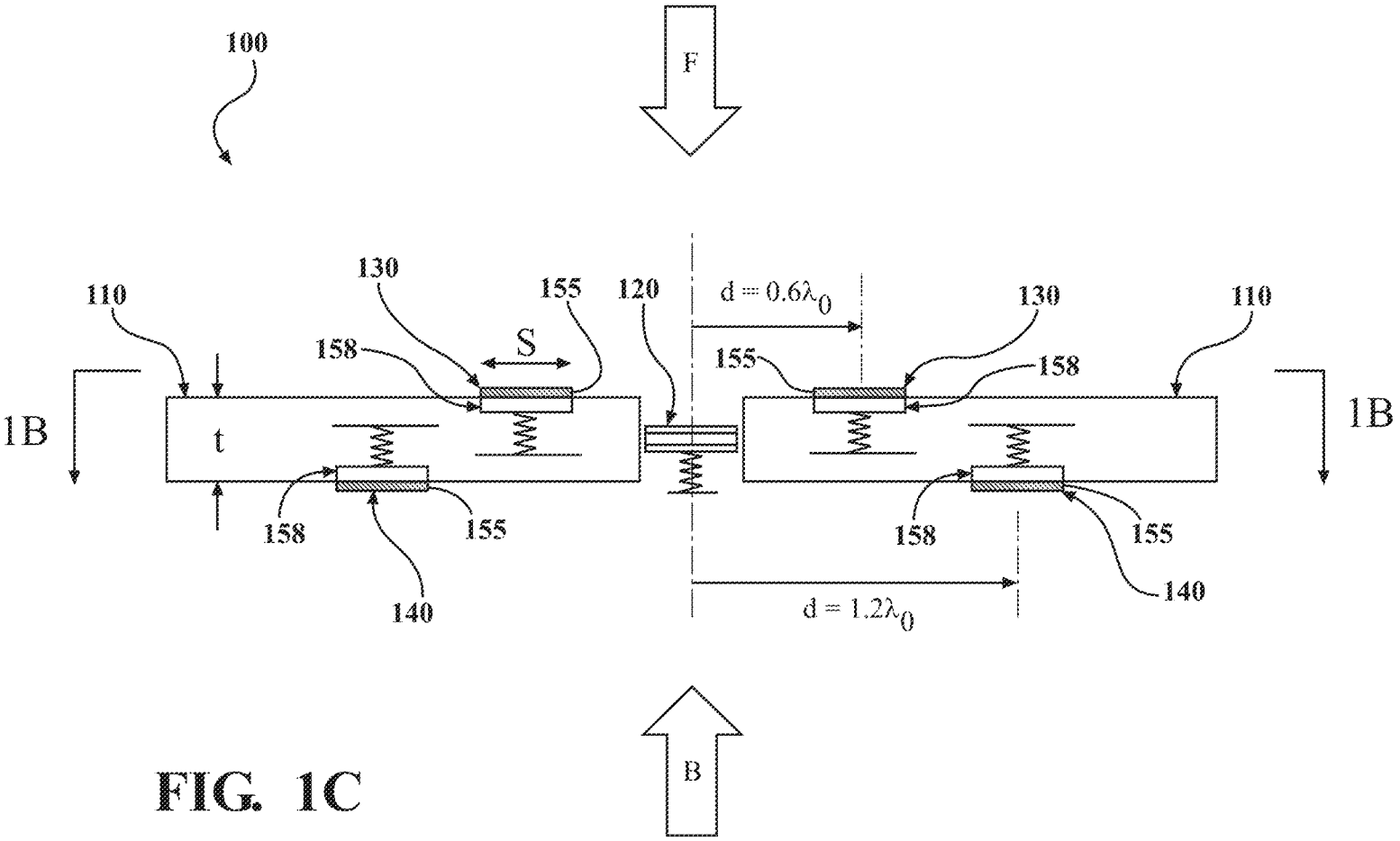
FIG. 1C is a side schematic view of the device of FIG. 1A, with resonators depicted as spring resonators.

FIGS. 1A and 1B show a side schematic view and a top plan view, respectively, of a disclosed one-way sound transmission device 100 (alternatively referred to as "the device 100"). FIG. 1C shows a side schematic view of the device 100, similar to that of FIG. 1A, in which the device 100 is depicted abstractly. The device includes a substantially planar substrate 110, having first and second opposing planar surfaces 112, 114, and formed of an acoustically reflective material. The substantially planar substrate 110 can be formed of a thermoplastic, a metal, or a glass and, in some instances, can be formed of transparent silica glass. The substantially planar substrate 110 can generally have a thickness, represented by tin FIG. 1C, sufficient to ensure rigidity that will enable the substantially planar substrate 110 to function as a sound reflector. In some implementations in which the substantially planar substrate 110 is formed of silica glass, the substrate can have a thickness, t, of from about one to ten millimeters.

With continued reference to FIGS. 1A and 1B, the one-way sound transmission device 100 includes an aperture 115 in the substantially planar substrate 110, the aperture 115 being traversed by an elastic membrane 120. The elastic membrane 120 can be formed of a thin layer of elastic material, such as a polymeric resin including various synthetic thermoplastics, latex, and any other suitable material. The elastic membrane 120 can have a thickness of from around a few tens of micrometers to several hundred micrometers.

The elastic membrane has an acoustic resonance frequency, $f_0$. It will be understood that this means that, when an incident acoustic wave possessing a frequency component that is near or equivalent to the acoustic resonance frequency, $f_0$, of the elastic membrane 120, the elastic membrane 120 will vibrate, at this frequency, with an amplitude proportional to the amplitude of the resonance frequency component. As discussed below, the elastic membrane 120 can optionally be replaced with an alternative dipole, or bidirectional, acoustic resonator. With that understanding in mind, the term "elastic membrane" will be employed henceforth.

With particular reference to FIG. 1A, the device 100 includes a pair of forward-facing resonators 130 (referred to alternatively as "forward resonators 130") disposed on the first surface 112, and a pair of backward-facing resonators 140 (referred to alternatively as "backward resonators 140") disposed on the second surface 114. Each resonator 130, 140 has the acoustic resonance frequency, $f_0$. Referring to FIG. 1B, in which the resonators 130, 140 are depicted as monopole spring resonators, each forward resonator 130 is positioned at a center-to-center distance $0.6\lambda_0$, where $\lambda_0$ is the wavelength corresponding to the resonance frequency, $f_0$. Similarly, each backward resonator 140 is positioned at a center-to-center distance $1.2\lambda_0$.

In different implementations, the forward and backward resonators 130, 140 can include any different monopole resonators, configured to resonantly reflect acoustic waves propagating from one direction. To this point, the abstract view of FIG. 1C depicts the forward and backward resonators 130, 140 as monopole spring resonators. In particular, the forward resonators 130 can be configured to reflect acoustic waves propagating generally from the forward direction, indicated by the block arrow F of FIG. 1A. Similarly, backward resonators 140 can be configured to reflect acoustic waves propagating generally from the backward direction, indicated by the block arrow B of FIG. 1A. Suitable types of resonators for use as the forward and backward resonators 130, 140 can include Helmholtz resonators, quarter-wave resonators, any other suitable type, and combinations thereof. In some implementations, both forward resonators 130 can be of the same type (e.g. Helmholtz) and both backward resonators 140 can be of the same type. In some implementations, all four of the forward and backward resonators 130, 140 can be of the same type.

With reference to FIG. 1B, it will be noted that the forward resonators 130 are generally positioned symmetrically around the elastic membrane 120, meaning that forward resonators 130 are spaced apart from the elastic membrane in opposite directions, such that the two forward resonators 130 and the elastic membrane are in-line with one another. Similarly, the backward resonators 140 are generally positioned symmetrically around the elastic membrane 120.

It will be understood that the design parameters described above create a scenario in which sound waves having the frequency, $f_0$, and propagating toward the device 100 from the forward direction, F, of FIG. 1A will be transmitted by the elastic membrane 120; whereas such sound waves propagating toward the device 100 from the backward direction, B, of FIG. 1A will not be transmitted by the elastic membrane 120. It will be further understood that this results from coupling between the forward resonators 130 and the elastic membrane 120, with substantially constructive interference, enabling the elastic membrane 120 to transmit sound of frequency $f_0$ when it is propagating from the forward direction. Conversely, coupling between the backward resonators 140 and the elastic membrane 120 is characterized by substantially destructive interference, preventing the elastic membrane 120 from transmitting sound of frequency $f_0$ when it is propagating from the backward direction. It will be appreciated that this differential coupling is caused by the difference in spacing between the forward resonators 130 and the backward resonators 140, relative to the elastic membrane 120.

Stated more particularly, and with continued reference to FIG. 1C, the resonators 130, 140 of the device 100 are represented as a lumped spring-mass model in FIG. 1C, thereby representing a generalization of acoustic resonators. In FIG. 1C, the thick lines 155 on the resonator masses 158 indicate the interface, where the masses interact with free space. The forward and backward resonators 130, 140 have only one interface 155 interacting with free space (indicating they are monopole, or unidirectional resonators), whereas the elastic membrane 120 has two interfaces 155 interacting with free space (indicating it is a dipole, or bidirectional, resonator). Thus, the forward and backward resonators 130, 140 can be substituted with any type of monopole resonators such as Helmholtz or quarter-wave resonators, and the elastic membrane 120 can be replaced with any dipole resonator.

One-way sound transmission results from an asymmetrical arrangement of the top and bottom resonators. For the forward propagation, the top resonators constructively interfere with the elastic membrane, enabling sound transmission. However, for the backward propagation, the bottom resonators destructively interfere with the elastic membrane, suppressing sound transmission. The condition for destructive or constructive interference in the device 100 is expressed by Equations 1 and 2, respectively:

$$\mathrm{Arg}[H_0^{(2)}(kd)]=2n\pi \quad (1)$$

$$\mathrm{Arg}[H_0^{(2)}(kd)]=(2n-1)\pi \quad (2)$$

where Arg is the argument of a complex value; $H_0^{(2)}$ is the zeroth-order (spherical) Hankel function of the second kind for 2D (3D), k is the wavenumber ($2\pi/\lambda_0$); d is the distance of separation between the elastic membrane 120 and each resonator 130, 140 in a given pair; and n is the integer.

It will be generally understood that FIGS. 1A-1C are not to scale, and that the width, S, of an individual resonator 130, 140 is small compared to the wavelength ($\lambda_0$). For example, each resonator 130, 140 can have a width that is equal to about $0.05\lambda_0$ to about $0.3\lambda_0$. As noted above, the distance ($d_F$) of each forward resonator 130 from the center is about $0.6\lambda_0$, while the distance ($d_B$) of each backward resonator from the center is larger, e.g. about $1.2\lambda_0$.

Figure 2A:
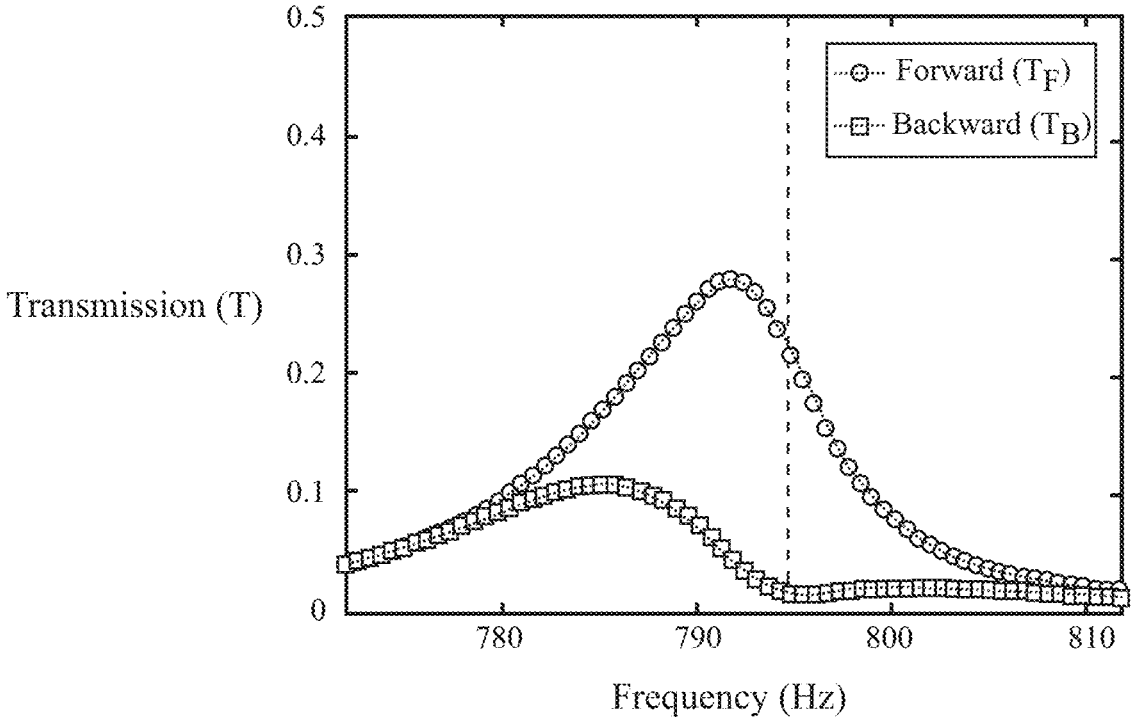
FIG. 2A is a plot of transmission, in forward and backward directions, as a function of frequency for a device of FIGS. 1A-1C.
Figure 2B:
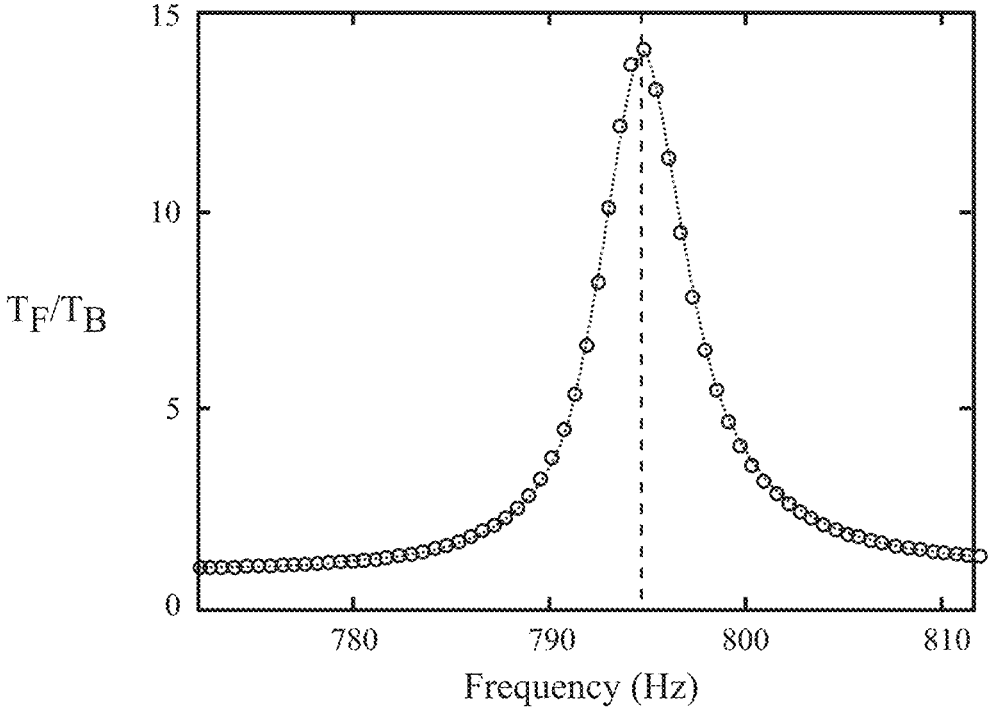
FIG. 2B is a plot of differential (ratio between forward and backward) transmission as a function of frequency for a device of FIGS. 1A-1C.

A numerical simulation using the lumped spring-mass model of FIG. 1C is shown in FIG. 2A, showing a plot of transmission, in forward and backward directions, as a function of frequency for the disclosed device 100. It will be understood that the resonators 130, 140 and the elastic membrane 120 in the simulation of FIG. 2A have a resonance frequency, $f_0$, of about 790 Hz. As shown in the results of FIG. 2A, transmission in the forward direction substantially exceeds transmission in the backward direction across the range from about 785 Hz to about 800 Hz. FIG. 2B is a differential (ratio between forward and backward transmission) plot of the data of FIG. 2A, and shows that there is an approximately 15-fold difference in transmission between the forward and backward directions at 795 Hz.

Figure 3A:
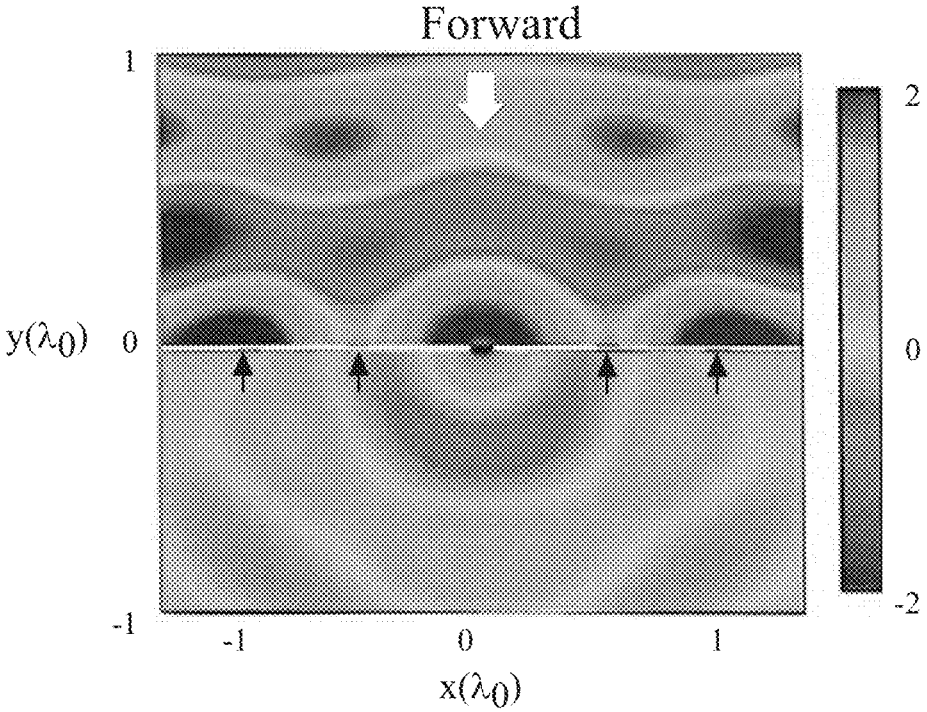
FIGS. 3A and 3B are sound pressure fields for forward and backward propagation, respectively, through the device of FIGS. 1A-1C.
Figure 3B:
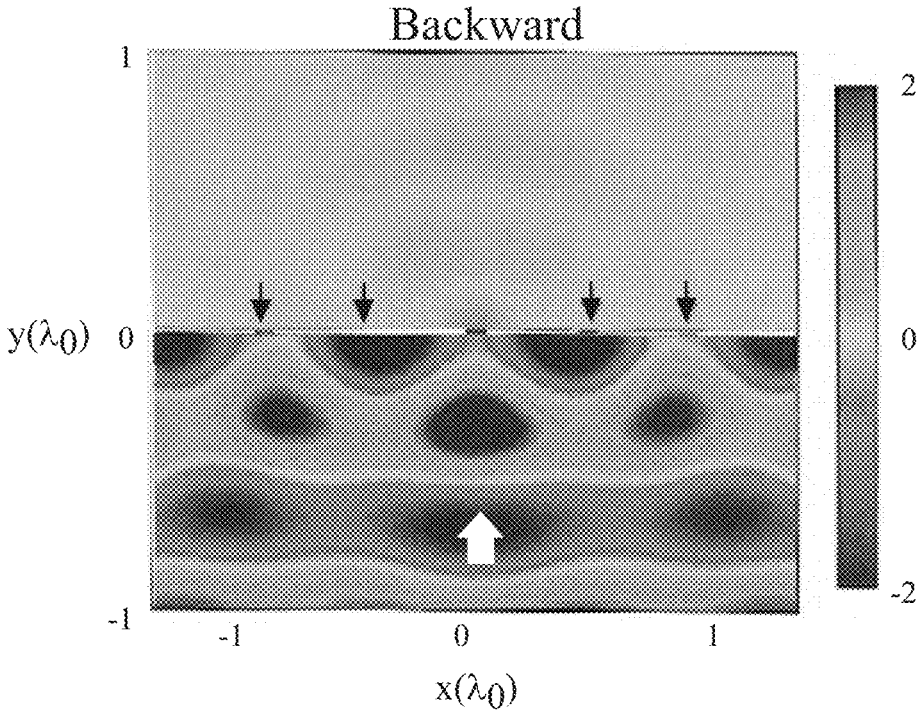

FIGS. 3A and 3B show sound pressure fields for forward and backward propagation, respectively, through the device analyzed in FIGS. 2A and 2B. These results highlight the constructive and destructive interference effects that enable one-way sound transmission in the device 100.

In some implementations, the device 100 of FIGS. 1A-1C can be deployed as a unit cell in a one-dimensional or two-dimensional periodic array. For example, and considering the top plan view of FIG. 1B, the device 100 of FIG. 1B can be periodically repeated in one dimension, thereby creating a one-way sound transmitting strip. Similarly, the device 100 of FIG. 1B can be periodically repeated in two dimensions, thereby creating a one-way sound transmitting wall or panel.

In a particular example, a glass panel configured for one-way sound transmission is disclosed. The disclosed glass panel can be a two-dimensional, periodic array of unit cells, each unit cell being a one-way sound transmission device 100 as described above. In such a panel, the substantially planar substrate 110 will be glass (i.e. substantially transparent silica glass), and the panel can be optimized for one-way sound transmission at a desired wavelength, based on the resonance frequencies of the elastic membrane 120 and resonators 130, 140, as described above. In some specific implementations, the panel can be configured for enhanced bandwidth of differential (ratio between forward and backward) sound transmission, by utilizing a unit cell formed of multiple devices 100, in which two or more devices of the unit cell have resonators 130, 140 and elastic membrane 120 with different resonance frequency, $f_0$.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. A one-way sound transmission device comprising:

a substantially planar substrate formed of an acoustically reflective material and comprising:

a first surface;

a second surface opposite the first surface; and an aperture;

an elastic membrane traversing the aperture and having a resonance frequency, $f_0$;

a first pair of resonators positioned on the first surface and having the resonance frequency, $f_0$, each resonator of the first pair of resonators spaced apart from the aperture by a center-to-center distance, of about $0.6\lambda_0$, where $\lambda_0$ is a wavelength corresponding to $f_0$; and a second pair of resonators positioned on the second surface and having the resonance frequency, $f_0$, each resonator of the second pair of resonators spaced apart from the aperture by a center-to-center distance, of about $1.2\lambda_0$.

2. The one-way sound transmission device as recited in claim 1, wherein the substantially planar substrate is glass.

3. The one-way sound transmission device as recited in claim 1, wherein the first pair of resonators and the second pair of resonators are Helmholtz resonators.

4. The one-way sound transmission device as recited in claim 1, wherein the first pair of resonators and the second pair of resonators are quarter-wave resonators.

5. The one-way sound transmission device as recited in claim 1, wherein the two resonators of the first pair of resonators are spaced apart from the aperture in opposite directions.

6. The one-way sound transmission device as recited in claim 1, wherein the elastic membrane is a latex membrane.

7. The one-way sound transmission device as recited in claim 1, wherein the two resonators of the second pair of resonators are spaced apart from the aperture in opposite directions.

8. A one-way sound transmission device comprising:

a substantially planar substrate formed of an acoustically reflective material and comprising:

a first surface;

a second surface opposite the first surface; and an aperture;

a dipole acoustic resonator positioned in the aperture and having a resonance frequency, $f_0$;

a first pair of monopole resonators positioned on the first surface and having the resonance frequency, $f_0$, each resonator of the first pair of resonators spaced apart from the aperture by a center-to-center distance, $0.6\lambda_0$, where $\lambda_0$ is a wavelength corresponding to $f_0$, and configured to resonantly reflect acoustic waves impinging on the first surface; and a second pair of monopole resonators positioned on the second surface and having the resonance frequency, $f_0$, each resonator of the second pair of resonators spaced apart from the aperture by a center-to-center distance, $1.2\lambda_0$, and configured to resonantly reflect acoustic waves impinging on the second surface.

9. The one-way sound transmission device as recited in claim 8, wherein the substantially planar substrate is glass.

10. The one-way sound transmission device as recited in claim 8, wherein the first pair of resonators and the second pair of resonators are Helmholtz resonators.

11. The one-way sound transmission device as recited in claim 8, wherein the first pair of resonators and the second pair of resonators are quarter-wave resonators.

12. The one-way sound transmission device as recited in claim 8, wherein the two resonators of the first pair of resonators are spaced apart from the aperture in opposite directions.

13. The one-way sound transmission device as recited in claim 8, wherein the dipole acoustic resonator is a latex membrane.

14. The one-way sound transmission device as recited in claim 8, wherein the two resonators of the second pair of resonators are spaced apart from the aperture in opposite directions.

15. A one-way sound transmission panel, comprising a two-dimensional array of periodic unit cells, each unit cell comprising:

a substantially planar glass substrate comprising:

a first surface;

a second surface opposite the first surface; and an aperture;

an elastic membrane traversing the aperture and having a resonance frequency, $f_0$;

a first pair of resonators positioned on the first surface and having the resonance frequency, $f_0$, each resonator of the first pair of resonators spaced apart from the aperture by a center-to-center distance, of about $0.6\lambda_0$, where $\lambda_0$ is a wavelength corresponding to $f_0$; and a second pair of resonators positioned on the second surface and having the resonance frequency, $f_0$, each resonator of the second pair of resonators spaced apart from the aperture by a center-to-center distance, of about $1.2\lambda_0$.

16. The one-way sound transmission panel as recited in claim 15, wherein the first pair of resonators and the second pair of resonators are Helmholtz resonators.

17. The one-way sound transmission panel as recited in claim 15, wherein the first pair of resonators and the second pair of resonators are quarter-wave resonators.

18. The one-way sound transmission panel as recited in claim 15, wherein the two resonators of the first pair of resonators are spaced apart from the aperture in opposite directions.

19. The one-way sound transmission panel as recited in claim 15, wherein the elastic membrane is a latex membrane.

20. The one-way sound transmission panel as recited in claim 15, wherein the two resonators of the second pair of resonators are spaced apart from the aperture in opposite directions.

* * * * *